US010359714B2

(12) United States Patent
Okada

(10) Patent No.: US 10,359,714 B2
(45) Date of Patent: Jul. 23, 2019

(54) ELECTROPHOTOGRAPHIC PHOTOSENSITIVE MEMBER

(71) Applicant: KYOCERA Document Solutions Inc., Osaka (JP)

(72) Inventor: Hideki Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/168,101

(22) Filed: Oct. 23, 2018

(65) Prior Publication Data

US 2019/0129321 A1 May 2, 2019

(30) Foreign Application Priority Data

Oct. 27, 2017 (JP) ..... 2017-208003

(51) Int. Cl.
*G03G 5/06* (2006.01)

(52) U.S. Cl.
CPC ..... *G03G 5/0651* (2013.01); *G03G 5/0614* (2013.01)

(58) Field of Classification Search
CPC ..... G03G 5/0651
See application file for complete search history.

(56) References Cited

U.S. PATENT DOCUMENTS 5,616,441 A * 4/1997 Kawaguchi ..... C07D 487/04 430/78
7,291,429 B2 11/2007 Kim et al.
2005/0112482 A1 5/2005 Kim et al.

FOREIGN PATENT DOCUMENTS

EP 2738612 A1 * 6/2014 ..... G03G 5/0609
JP 2005-154444 A 6/2005

OTHER PUBLICATIONS

Hasegawa, T.; Ashizawa, M.; Aoyagi, K.; Masunaga, H.; Hikima, T.; Matsumoto, H. Thiadiazole-fused Quinoxalineimide as an Electron-deficient Building Block for N-type Organic Semiconductors. Org. Lett. 2017, 19, 3275-3278. (Year: 2017).*

(Continued)

*Primary Examiner* — Christopher D Rodee
(74) *Attorney, Agent, or Firm* — Studebaker & Brackett PC

(57) ABSTRACT

An electrophotographic photosensitive member includes a conductive substrate and a single-layer photosensitive layer. The photosensitive layer contains at least a charge generating material and a compound represented by general formula (1). In general formula (1), $R^1$ represents an aryl group having a carbon number of at least 6 and no greater than 22 and optionally having an alkyl group having a carbon number of at least 1 and no greater than 10, an alkyl group having a carbon number of at least 3 and no greater than 20, an aralkyl group having a carbon number of at least 7 and no greater than 20, a cycloalkyl group having a carbon number of at least 3 and no greater than 20, or an alkoxy group (Continued)

having a carbon number of at least 1 and no greater than 6. Chemical groups $R^2$ each represent a halogen atom.

(1)

8 Claims, 1 Drawing Sheet

(56) References Cited

OTHER PUBLICATIONS

Borsenberger, P.M.; Weiss, D.S. Organic Photoreceptors for Imaging Systems. Marcel-Dekker, Inc.: New York, 1993, pp. 6-17.(Year: 1993).*

* cited by examiner

ELECTROPHOTOGRAPHIC PHOTOSENSITIVE MEMBER

INCORPORATION BY REFERENCE

The present application claims priority under 35 U.S.C. § 119 to Japanese Patent Application No. 2017-208003, filed on Oct. 27, 2017. The contents of this application are incorporated herein by reference in their entirety.

BACKGROUND

The present disclosure relates to an electrophotographic photosensitive member.

An electrophotographic photosensitive member is used in an electrographic image forming apparatus. A multi-layer electrophotographic photosensitive member or a single-layer electrophotographic photosensitive member is for example used as the electrophotographic photosensitive member. The multi-layer electrophotographic photosensitive member includes a photosensitive layer that includes a charge generating layer having a charge generation function and a charge transport layer having a charge transport function. The single-layer electrophotographic photosensitive member includes a single-layer photosensitive layer having the charge generation function and the charge transport function.

The electrophotographic photosensitive member includes a photosensitive layer.

In an example, the photosensitive layer contains a naphthalenetetracarboxylic diimide derivative having a structure represented by chemical formula (E-1) as an electron transport material.

(E-1)

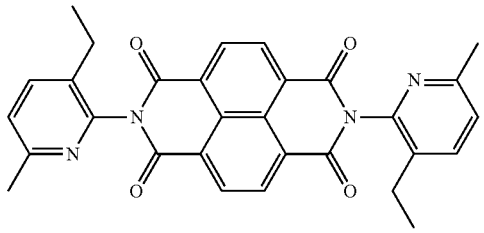

SUMMARY

An electrophotographic photosensitive member according to the present disclosure includes a conductive substrate and a photosensitive layer. The photosensitive layer is a single layer. The photosensitive layer contains at least a charge generating material and a compound represented by general formula (1) shown below.

(1)

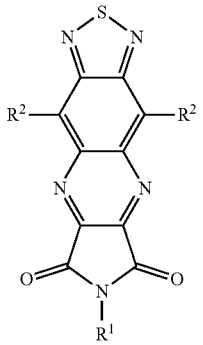

In general formula (1), $R^1$ represents an aryl group having a carbon number of at least 6 and no greater than 22 and optionally having an alkyl group having a carbon number of at least 1 and no greater than 10, an alkyl group having a carbon number of at least 3 and no greater than 20, an aralkyl group having a carbon number of at least 7 and no greater than 20, a cycloalkyl group having a carbon number of at least 3 and no greater than 20, or an alkoxy group having a carbon number of at least 1 and no greater than 6. Chemical groups $R^2$ each represent a halogen atom.

DETAILED DESCRIPTION

Figure 1A:
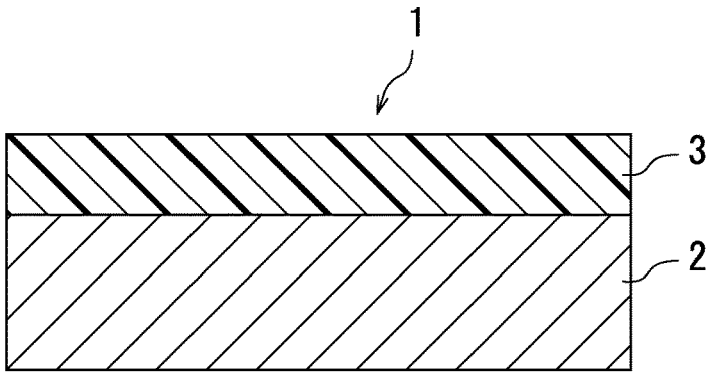
FIGS. 1A, 1B, and 1C each are a cross-sectional view illustrating an example of an electrophotographic photosensitive member according to an embodiment of the present disclosure.

The following describes an embodiment of the present disclosure in detail. The present disclosure is by no means limited to the following embodiment. The present disclosure can be practiced with alterations appropriately made within a scope of the objects of the present disclosure. Note that although some overlapping explanations may be omitted as appropriate, such omission does not limit the gist of the present disclosure.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. When the term "-based" is appended to the name of a chemical compound used in the name of a polymer, the term indicates that a repeating unit of the polymer originates from the chemical compound or a derivative thereof. Also, the terms a group "optionally having a group", a group "having a group", a group "optionally having a halogen atom", and a group "having a halogen atom" respectively mean a group "optionally substituted by a group", a group "substituted by a group", a group "optionally substituted by a halogen atom", and a group "substituted by a halogen atom".

In the following description, a halogen atom, an alkyl group having a carbon number of at least 1 and no greater than 10, an alkyl group having a carbon number of at least 1 and no greater than 6, an alkyl group having a carbon number of at least 1 and no greater than 3, an alkyl group having a carbon number of at least 3 and no greater than 20, an alkyl group having a carbon number of at least 4 and no greater than 10, an alkyl group having a carbon number of at least 6 and no greater than 8, an alkyl group having a carbon number of 6 or 8, an alkoxy group having a carbon number of at least 1 and no greater than 6, an alkoxy group having a carbon number of at least 1 and no greater than 3, an aryl group having a carbon number of at least 6 and no greater than 22, an aryl group having a carbon number of at least 6 and no greater than 14, an aryl group having a carbon number of at least 6 and no greater than 10, a cycloalkyl group having a carbon number of at least 3 and no greater than 20, a cycloalkyl group having a carbon number of at least 3 and no greater than 10, and an aralkyl group having a carbon number of at least 7 and no greater than 20 indicate the followings unless otherwise stated.

Examples of halogen atoms (halogen groups) include fluorine atom (fluoro group), chlorine atom (chloro group), bromine atom (bromo group), and iodine atom (iodine group).

Each of the alkyl group having a carbon number of at least 1 and no greater than 10, the alkyl group having a carbon number of at least 1 and no greater than 6, and the alkyl group having a carbon number of at least 1 and no greater than 3 is a straight chain or branched chain alkyl group. Examples of alkyl groups having a carbon number of at least 1 and no greater than 10 include methyl group, ethyl group, n-propyl group, isopropyl group, n-butyl group, sec-butyl group, tert-butyl group, n-pentyl group, isopentyl group, neopentyl group, 1,2-dimethylpropyl group, straight chain or branched chain hexyl group, straight chain or branched chain heptyl group, straight chain or branched chain octyl group, straight chain or branched chain nonyl group, and straight chain or branched chain decyl group. Examples of alkyl groups having a carbon number of at least 1 and no greater than 6 include alkyl groups having a carbon number of at least 1 and no greater than 6 among the above-listed examples of alkyl groups having a carbon number of at least 1 and on greater than 10. Examples of alkyl groups having a carbon number of at least 1 and no greater than 3 include alkyl groups having a carbon number of at least 1 and no greater than 3 among the above-listed examples of alkyl groups having a carbon number of at least 1 and on greater than 10.

Each of the alkyl group having a carbon number of at least 3 and no greater than 20, the alkyl group having a carbon number of at least 4 and no greater than 10, the alkyl group having a carbon number of at least 6 and no greater than 8, and the alkyl group having a carbon number of 6 or 8 is a straight chain or branched chain alkyl group. Examples of alkyl groups having a carbon number of at least 3 and no greater than 20 include n-propyl group, isopropyl group, n-butyl group, sec-butyl group, tert-butyl group, n-pentyl group, isopentyl group, neopentyl group, 1,2-dimethylpropyl group, straight chain or branched chain hexyl group, straight chain or branched chain heptyl group, straight chain or branched chain octyl group, straight chain or branched chain nonyl group, straight chain or branched chain decyl group, straight chain or branched chain undecyl group, straight chain or branched chain dodecyl group, straight chain or branched chain tridecyl group, straight chain or branched chain tetradecyl group, straight chain or branched chain pentadecyl group, straight chain or branched chain hexadecyl group, straight chain or branched chain octadecyl group, straight chain or branched chain nonadecyl group, and straight chain or branched chain icosyl group. Examples of alkyl groups having a carbon number of at least 4 and no greater than 10 include alkyl groups having a carbon number of at least 4 and no greater than 10 among the above-listed examples of alkyl groups having a carbon number of at least 3 and no greater than 20. Examples of alkyl groups having a carbon number of at least 6 and no greater than 8 include alkyl groups having a carbon number of at least 6 and no greater than 8 among the above-listed examples of alkyl groups having a carbon number of at least 3 and on greater than 20. Examples of alkyl groups having a carbon number of 6 or 8 include alkyl groups having a carbon number of 6 or 8 among the above-listed examples of alkyl groups having a carbon number of at least 3 and on greater than 20.

Each of the alkoxy group having a carbon number of at least 1 and no greater than 6 and the alkoxy group having a carbon number of at least 1 and no greater than 3 is an unsubstituted straight chain or branched chain alkoxy group. Examples of alkoxy groups having a carbon number of at least 1 and no greater than 6 include methoxy group, ethoxy group, n-propoxy group, isopropoxy group, n-butoxy group, sec-butoxy group, tert-butoxy group, n-pentoxy group, isopentoxy group, neopentoxy group, and hexyloxy group. Examples of alkoxy groups having a carbon number of at least 1 and no greater than 3 include alkoxy groups having a carbon number of at least 1 and no greater than 3 among the above-listed examples of alkoxy groups having a carbon number of at least 1 and on greater than 6.

Each of the aryl group having a carbon number of at least 6 and no greater than 22, the aryl group having a carbon number of at least 6 and no greater than 14, and the aryl group having a carbon number of at least 6 and no greater than 10 is an unsubstituted aryl group. Examples of aryl groups having a carbon number of at least 6 and no greater than 22 include phenyl group, naphthyl group, indacenyl group, biphenylenyl group, acenaphthylenyl group, anthryl group, phenanthryl group, triphenylenyl group, pyrenyl group, chrysenyl group, naphthacenyl group, preiadenyl group, picenyl group, perylenyl group, pentaphenyl group, and pentacenyl group. Examples of aryl groups having a carbon number of at least 6 and no greater than 14 include phenyl group, naphthyl group, indacenyl group, biphenylenyl group, acenaphthylenyl group, anthryl group, and phenanthryl group. Examples of aryl groups having a carbon number of at least 6 and no greater than 10 include phenyl group and naphthyl group.

Each of the cycloalkyl groups having a carbon number of at least 3 and no greater than 20 and the cycloalkyl group having a carbon number of at least 3 and no greater than 10 is an unsubstituted cycloalkyl group. Examples of cycloalkyl groups having a carbon number of at least 3 and no greater than 20 include cyclopropyl group, cyclobutyl group, cyclopentyl group, cyclohexyl group, cycloheptyl group, cyclooctyl group, cyclononyl group, cyclodecyl group, cycloundecyl group, cyclododecyl group, cyclotridecyl group, cyclotetradecyl group, cyclopentadecyl group, cyclohexadecyl group, cyclooctadecyl group, cyclononadecyl group, and cycloicosyl group. Examples of cycloalkyl groups having a carbon number of at least 3 and no greater than 10 include cycloalkyl groups having a carbon number of at least 3 and no greater than 10 among the above-listed examples of cycloalkyl groups having a carbon number of at least 3 and no greater than 20.

The aralkyl group having a carbon number of at least 7 and no greater than 20 is an unsubstituted aralkyl group. Examples of aralkyl groups having a carbon number of at least 7 and no greater than 20 include an alkyl group having a carbon number of at least 1 and no greater than 6 and having an aryl group having a carbon number of at least 6 and no greater than 14.

<Electrophotographic Photosensitive Member>

Figure 1B:
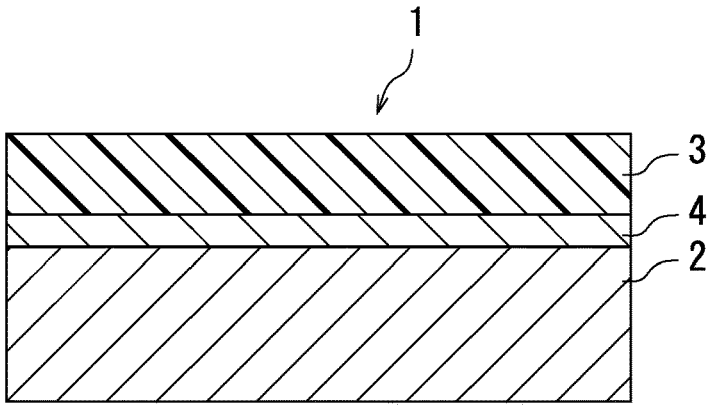
Figure 1C:
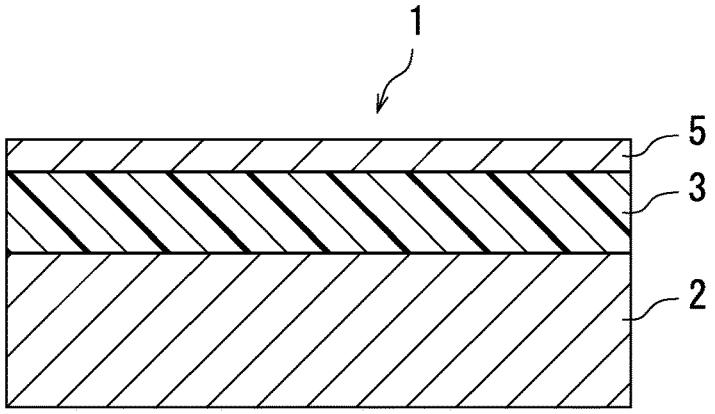

The present embodiment relates to an electrophotographic photosensitive member (also referred to below as a photosensitive member). A configuration of a photosensitive member 1 will be described below with reference to FIGS. 1A to 1C. FIGS. 1A to 1C each are a cross-sectional view illustrating an example of the photosensitive member 1 according to the present embodiment.

As illustrated in FIG. 1A, the photosensitive member 1 includes for example a conductive substrate 2 and a photosensitive layer 3. The photosensitive layer 3 is a single layer (one layer). The photosensitive member 1 is a single-layer electrophotographic photosensitive member including a single-layer photosensitive layer 3.

As illustrated in FIG. 1B, the photosensitive member 1 may include an intermediate layer 4 (undercoat layer) in addition to the conductive substrate 2 and the photosensitive layer 3. The intermediate layer 4 is disposed between the conductive substrate 2 and the photosensitive layer 3. The photosensitive layer 3 may be disposed directly on the conductive substrate 2, as illustrated in FIG. 1A. The photosensitive layer 3 may alternatively be disposed on the conductive substrate 2 with the intermediate layer 4 therebetween, as illustrated in FIG. 1B. The intermediate layer 4 may include a single layer or a plurality of layers.

As illustrated in FIG. 1C, the photosensitive member 1 may include a protective layer 5 in addition to the conductive substrate 2 and the photosensitive layer 3. The protective layer 5 is disposed on the photosensitive layer 3. The protective layer 5 may include a single layer or a plurality of layers.

Thickness of the photosensitive layer 3 is not particularly limited so long as the photosensitive layer 3 is enabled to sufficiently exhibit a function as the photosensitive layer 3. The thickness of the photosensitive layer 3 is preferably at least 5 μm and no greater than 100 μm, and more preferably at least 10 μm and no greater than 50 μm. The configuration of the photosensitive member 1 has been described so far with reference to FIGS. 1A to 1C. The following further describes the photosensitive member in detail.

<Photosensitive Layer>

The photosensitive layer contains at least a charge generating material and a compound represented by general formula (1). The photosensitive layer may further contain a hole transport material. The photosensitive layer may further contain a binder resin. The photosensitive layer may contain an additive as necessary.

(Compound Represented by General Formula (1))

The photosensitive layer contains the compound represented by general formula (1) (also referred to below as a compound (1)). The photosensitive layer contains the compound (1) for example as an electron transport material.

(1)

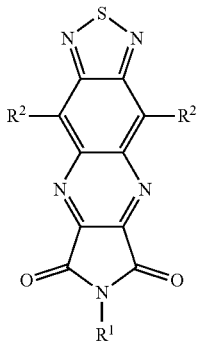

In general formula (1), $R^1$ represents: an aryl group having a carbon number of at least 6 and no greater than 22 and optionally having an alkyl group having a carbon number of at least 1 and no greater than 10; an alkyl group having a carbon number of at least 3 and no greater than 20; an aralkyl group having a carbon number of at least 7 and no greater than 20; a cycloalkyl group having a carbon number of at least 3 and no greater than 20; or an alkoxy group having a carbon number of at least 1 and no greater than 6. Chemical groups $R^2$ each represent a halogen atom.

As a result of the photosensitive layer containing the compound (1), sensitivity characteristics of the photosensitive member can be improved. Reasons for the above are presumed as follows.

The compound (1) includes a specific chemical structure having an imide group and including a benzothiadiazole ring moiety substituted by a halogen atom (i.e., $R^2$ group). The compound (1) having such a chemical structure has remarkable electron acceptability. Therefore, ability of the compound (1) in accepting electrons from a charge generating material and ability thereof in accepting electrons among the compound (1) are improved resulting in improvement of sensitivity characteristics of the photosensitive member.

Furthermore, a line (also referred to below as a line Z) passing two nitrogen atoms present in a pyrazine moiety in general formula (1) is assumed. The structure of the compound (1) is asymmetric with respect to the line Z. As a result of the compound (1) having such the specific chemical structure that is asymmetric, solubility of the compound (1) is improved in a solvent for photosensitive layer formation. As a result of the compound (1) having such the specific chemical structure that is asymmetric, compatibility of the compound (1) with a binder resin is also improved. When solubility and compatibility of the compound (1) are improved, uniform formation of the photosensitive layer can be achieved and sensitivity characteristics of the photosensitive member can be improved. Furthermore, crystallization of the photosensitive layer of the photosensitive member can be inhibited.

The aryl group having a carbon number of at least 6 and no greater than 22 represented by $R^1$ is preferably an aryl group having a carbon number of at least 6 and no greater than 14, more preferably an aryl group having a carbon number of at least 6 and no greater than 10, and further preferably a phenyl group. The aryl group having a carbon number of at least 6 and no greater than 22 represented by $R^1$ may have an alkyl group having a carbon number of at least 1 and no greater than 10 as a substituent. The alkyl group having a carbon number of at least 1 and no greater than 10 such as above is preferably an alkyl group having a carbon number of at least 1 and no greater than 6, more preferably an alkyl group having a carbon number of at least 1 and no greater than 3, and further preferably a methyl group or an ethyl group. The number of substituents that the aryl group having a carbon number of at least 6 and no greater than 22 has (alkyl groups having a carbon number of at least 1 and no greater than 10) is preferably at least 1 and no greater than 5, more preferably at least 1 and no greater than 3, and further preferably 1 or 2. The aryl group having a carbon number of at least 6 and no greater than 22 and having an alkyl group having a carbon number of at least 1 and no greater than 10 is preferably an aryl group having a carbon number of at least 6 and no greater than 14 and having an alkyl group having a carbon number of at least 1 and no greater than 6, more preferably an aryl group having a carbon number of at least 6 and no greater than 10 and having an alkyl group having a carbon number of at least 1 and no greater than 3, further preferably a phenyl group having a methyl group and an ethyl group, and particularly preferably a 2-ethyl-6-methylphenyl group.

The alkyl group having a carbon number of at least 3 and no greater than 20 represented by $R^1$ is preferably an alkyl group having a carbon number of at least 4 and no greater than 10, more preferably an alkyl group having a carbon number of at least 6 and no greater than 8, further preferably an alkyl group having a carbon number of 6 or 8, and particularly preferably an n-hexyl group or a 2-ethylhexyl group.

The aralkyl group having a carbon number of at least 7 and no greater than 20 represented by $R^1$ is preferably an alkyl group having a carbon number of at least 1 and no greater than 6 and having an aryl group having a carbon number of at least 6 and no greater than 14, more preferably an alkyl group having a carbon number of at least 1 and no greater than 3 and having an aryl group having a carbon number of at least 6 and no greater than 10, further preferably a benzyl group, a phenethyl group, or a naphthylmethyl group, and particularly preferably a benzyl group.

The cycloalkyl group having a carbon number of at least 3 and no greater than 20 represented by $R^1$ is preferably a cycloalkyl group having a carbon number of at least 3 and no greater than 10.

The alkoxy group having a carbon number of at least 1 and no greater than 6 represented by $R^1$ is preferably an alkoxy group having a carbon number of at least 1 and no greater than 3.

The halogen atom represented by $R^2$ is preferably a chlorine atom, a fluorine atom, or a bromine atom, more preferably a fluorine atom or a bromine atom, and further preferably a bromine atom. The two chemical groups $R^2$ preferably represent halogen atoms of the same type.

In order to improve sensitivity characteristics of the photosensitive member, $R^1$ in general formula (1) preferably represents an aryl group having a carbon number of at least 6 and no greater than 22 and optionally having an alkyl group having a carbon number of at least 1 and no greater than 10, an alkyl group having a carbon number of at least 3 and no greater than 20, or an aralkyl group having a carbon number of at least 7 and no greater than 20.

In general formula (1), $R^1$ preferably represents an alkyl group having a carbon number of at least 4 and no greater than 10. In a configuration in which $R^1$ in general formula (1) represents such a long-chain alkyl group, solubility of the compound (1) in a solvent for photosensitive layer formation can be further improved and sensitivity characteristics of the photosensitive member can be further improved.

In order to improve sensitivity characteristics of the photosensitive member, it is preferable that in general formula (1), $R^1$ represents an alkyl group having a carbon number of at least 4 and no greater than 10 and the chemical groups $R^2$ each represent a bromine atom.

Preferable examples of the compound (1) for improvement of sensitivity characteristics of the photosensitive member include compounds represented by chemical formulas (1-1), (1-2), (1-3), (1-4), and (1-5) (also referred to below as compounds (1-1), (1-2), (1-3), (1-4), and (1-5), respectively). In terms of further improving sensitivity characteristics of the photosensitive member, the compounds (1-1), (1-2), and (1-3) are more preferable as the compound (1), and compounds (1-1) and (1-2) are further preferable.

(1-1)

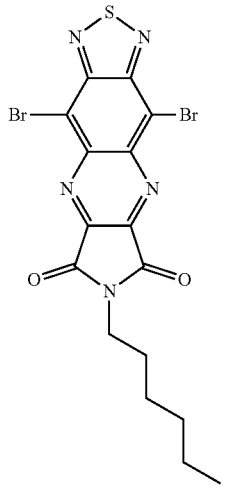

(1-2)

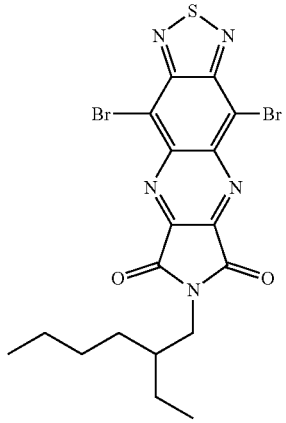

(1-3)

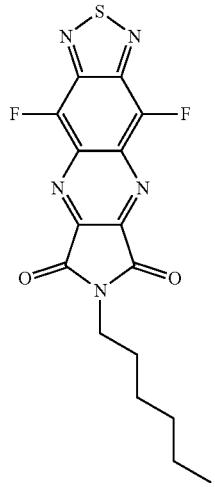

-continued (1-4)

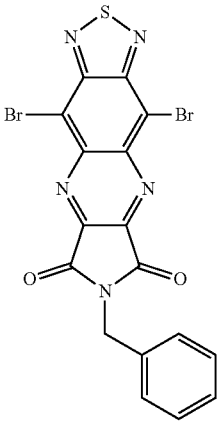

(1-5)

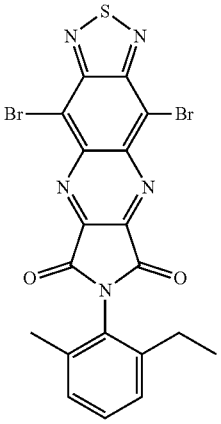

The photosensitive layer may contain only the compound (1) as the electron transport material. Alternatively, the photosensitive layer may further contain an electron transport material other than the compound (1) (also referred to below as an additional electron transport material) in addition to the compound (1). Examples of the additional electron transport material include quinone compounds, diimide-based compounds, hydrazone-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone compounds include diphenoquinone compounds, azoquinone compounds, anthraquinone compounds, naphthoquinone compounds, nitroanthraquinone compounds, and dinitroanthraquinone compounds.

The photosensitive layer may contain only one compound (1) or two or more compounds (1). The photosensitive layer may contain one additional electron transport material or two or more additional electron transport materials in addition to the compound (1). The compound (1) is preferably contained in an amount of at least 80% by mass relative to a total mass of the electron transport material(s), more preferably at least 90% by mass, and particularly preferably 100% by mass.

The compound (1) is preferably contained in an amount of 5 parts by mass and no greater than 100 parts by mass relative to 100 parts by mass of the binder resin, and more preferably at least 20 parts by mass and no greater than 40 parts by mass. When the compound (1) is contained in an amount of at least 5 parts by mass relative to 100 parts by mass of the binder resin, improvement in sensitivity characteristics of the photosensitive member can be facilitated. When the compound (1) is contained in an amount of no greater than 100 parts by mass relative to 100 parts by mass of the binder resin, the compound (1) readily dissolves in a solvent for photosensitive layer formation with a result that uniform formation of the photosensitive layer can be facilitated.

The following describes a method for producing the compound (1). The compound (1) is produced according to a reaction represented by reaction formula (R-1) (also referred to below as a reaction (R-1)) or a method conforming therewith. In the reaction (R-1), $R^2$ in general formula (A) and $R^1$ in general formula (B) are the same as defined for $R^2$ and $R^1$ in general formula (1), respectively. In the following description, compounds represented by general formulas (A) and (B) are referred to as compounds (A) and (B), respectively.

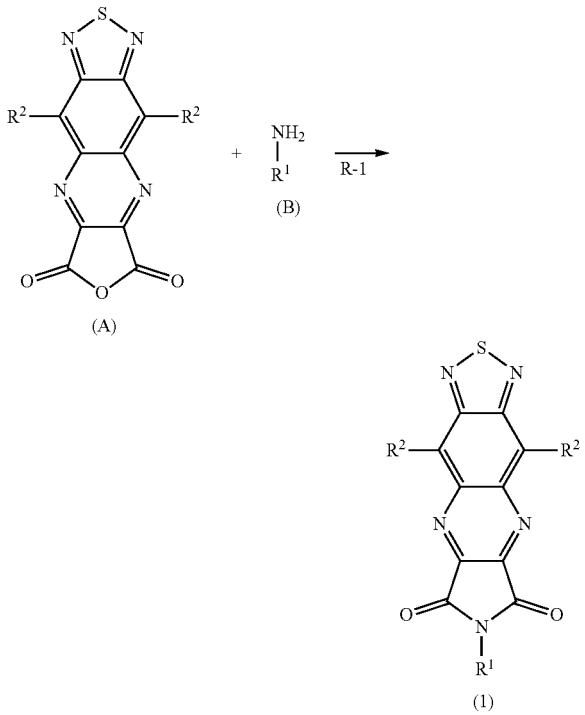

In the reaction (R-1), 1 mole equivalent of the compound (A) and 1 mole equivalent of the compound (B) are caused to react with each other to obtain 1 mole equivalent of the compound (1). Specifically, the compounds (A) and (B) are caused to react with each other in the presence of a base. Examples of the base include picoline, pyridine, and quinoline. The base can also act as a solvent. The reaction (R-1) may be carried out in an inert gas atmosphere (e.g., in a nitrogen gas atmosphere). The reaction (R-1) is preferably carried out at a reaction temperature of at least 100° C. and no greater than 180° C. The reaction (R-1) is preferably carried out for a reaction time of at least 1 hour and no greater than 10 hours. After the reaction (R-1) is carried out, the resultant compound (1) may be purified. Examples of purification methods include known methods (e.g., filtration, silica gel chromatography, and crystallization). Note that the method for producing the compound (1) may further include an appropriate process in addition to the reaction (R-1) as necessary.

(Charge Generating Material)

No specific limitation is placed on the charge generating material other than being a charge generating material for photosensitive member formation. Examples of charge generating materials include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (e.g., selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. The photosensitive layer may contain only one charge generating material or two or more charge generating materials.

Examples of phthalocyanine-based pigments include metal-free phthalocyanines and metal phthalocyanines. A metal-free phthalocyanine is represented for example by chemical formula (CGM2). Examples of metal phthalocyanines include titanyl phthalocyanine, hydroxygallium phthalocyanine, and chlorogallium phthalocyanine. A titanyl phthalocyanine is represented by chemical formula (CGM1). The phthalocyanine-based pigments may be crystalline or non-crystalline. The crystal form of the phthalocyanine-based pigments (e.g., α-form, β-form, Y-form, V-form, or II-form) is not particularly limited. Phthalocyanine-based pigments having various crystal forms can be used.

(CGM1)

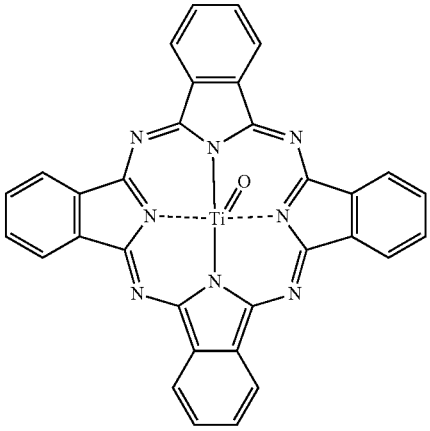

(CGM2)

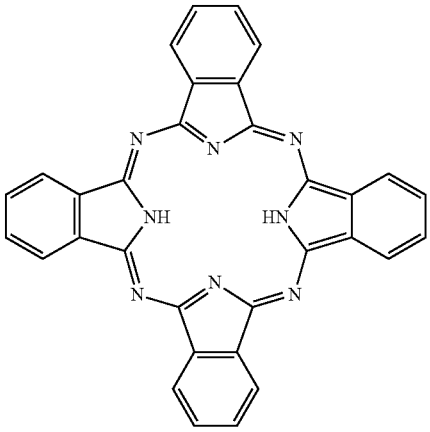

Examples of crystalline metal-free phthalocyanines include a metal-free phthalocyanine having an X-form crystal structure (hereinafter may be referred to as an X-form metal-free phthalocyanine). Examples of crystalline titanyl phthalocyanines include titanyl phthalocyanines having α-form, β-form, and Y-form crystal structures (hereinafter may be referred to as an α-form titanyl phthalocyanine, a β-form titanyl phthalocyanine, and a Y-form titanyl phthalocyanine, respectively).

For example, a digital optical image forming apparatus (e.g., a laser beam printer or facsimile machine with a light source such as a semiconductor laser) preferably adopts a photosensitive member having sensitivity in a wavelength range of at least 700 nm. In terms of high quantum yield in a wavelength range of at least 700 nm, the charge generating material is preferably a phthalocyanine-based pigment, more preferably a metal-free phthalocyanine or a titanyl phthalocyanine, further preferably an X-form metal-free phthalocyanine or a Y-form titanyl phthalocyanine, and particularly preferably a Y-form titanyl phthalocyanine.

The Y-form titanyl phthalocyanine has a main peak for example at a Bragg angle (2θ±0.2°) of 27.2° in a CuKα characteristic X-ray diffraction spectrum. The main peak in the CuKα characteristic X-ray diffraction spectrum refers to a peak having a highest or second highest intensity in a range of Bragg angles (2θ±0.2°) from 3° to 40°.

The following describes an example of a CuKα characteristic X-ray diffraction spectrum measuring method. A sample (titanyl phthalocyanine) is loaded into a sample holder of an X-ray diffractometer (e.g., "RINT (registered Japanese trademark) 1100", product of Rigaku Corporation), and an X-ray diffraction spectrum is measured using a Cu X-ray tube under conditions of a tube voltage of 40 kV, a tube current of 30 mA, and a wavelength of a CuKα characteristic X ray of 1.542 Å. The measurement range (2θ) is for example from 3° to 40° (start angle: 3°, stop angle: 40°), and the scanning speed is for example 10°/minute.

An anthanthrone-based pigment is preferably used as the charge generating material in a photosensitive member adopted in an image forming apparatus including a short-wavelength laser light source (e.g., a laser light source having a wavelength of at least 350 nm and no greater than 550 nm).

The charge generating material is preferably contained in an amount of at least 0.1 parts by mass and no greater than 50 parts by mass relative to 100 parts by mass of the binder resin contained in the photosensitive layer, more preferably at least 0.5 parts by mass and no greater than 30 parts by mass, and particularly preferably at least 0.5 parts by mass and no greater than 4.5 parts by mass.

(Hole Transport Material)

Examples of hole transport materials include triphenylamine derivatives, diamine derivatives (e.g., N,N,N',N'-tetraphenylbenzidine derivative, N,N,N',N'-tetraphenylphenylenediamine derivative, N,N,N',N'-tetraphenylnaphtylenediamine derivative, N,N,N',N'-tetraphenylphenanthrylenediamine derivative, and di(aminophenylethenyl)benzene derivative), oxadiazole-based compounds (e.g., 2,5-di(4-methylaminophenyl)-1,3,4-oxadiazole), styryl-based compounds (e.g., 9-(4-diethylaminostyryl)anthracene), carbazole-based compounds (e.g., polyvinyl carbazole), organic polysilane compounds, pyrazoline-based compounds (e.g., 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. The photosensitive layer may contain only one hole transport material or two or more hole transport materials.

The photosensitive layer preferably contains a compound represented by general formula (10) (also referred to below as a compound (10)). The photosensitive layer preferably contains the compound (10) for example as a hole transport material.

(10)

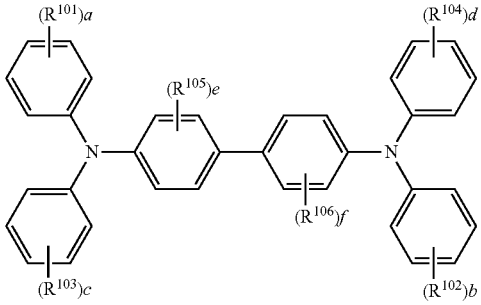

In general formula (10), $R^{101}$, $R^{102}$, $R^{103}$, $R^{104}$, $R^{105}$ and $R^{106}$ each represent, independently of one another, an alkyl group having a carbon number of at least 1 and no greater than 6, an alkoxy group having a carbon number of at least 1 and no greater than 6, or an aryl group having a carbon number of at least 6 and no greater than 14. Further, a, b, c, and d each represent, independently of one another, an integer of at least 0 and no greater than 5. Also, e and f each represent, independently of each other, an integer of at least 0 and no greater than 4.

Where a represents an integer of at least 2 and no greater than 5, the chemical groups $R^{101}$ may be the same as or different from one another. Where b represents an integer of at least 2 and no greater than 5, the chemical groups $R^{102}$ may be the same as or different from one another. Where c represents an integer of at least 2 and no greater than 5, the chemical groups $R^{103}$ may be the same as or different from one another. Where d represents an integer of at least 2 and no greater than 5, the chemical groups $R^{104}$ may be the same as or different from one another. Where e represents an integer of at least 2 and no greater than 4, the chemical groups $R^{105}$ may be the same as or different from one another. Where f represents an integer of at least 2 and no greater than 4, the chemical groups $R^{106}$ may be the same as or different from one another.

In general formula (10), $R^{101}$, $R^{102}$, $R^{103}$, $R^{104}$, $R^{105}$, and $R^{106}$ each preferably represent, independently of one another, an alkyl group having a carbon number of at least 1 and no greater than 6, more preferably an alkyl group having a carbon number of at least 1 and no greater than 3, and further preferably a methyl group. Further, a, b, c, and d each preferably represent, independently of one another, 0 or 1, and more preferably represent 1. Also, e and f each preferably represent, independently of each other, 0 or 1, and more preferably represent 1.

A preferable example of the compound (10) is a compound represented by chemical formula (10-1) shown below (also referred to below as a compound (10-1)).

(10-1)

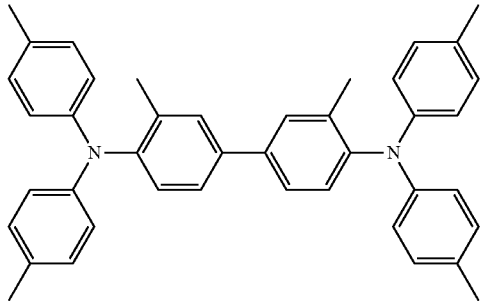

The photosensitive layer may contain only one compound (10) as the hole transport material. The photosensitive layer may alternatively contain two or more compounds (10) as the hole transport material. The one or more compounds (10) are preferably contained in an amount of at least 80% by mass relative to a total mass of the hole transport material(s), more preferably at least 90% by mass, and particularly preferably 100% by mass. Furthermore, the photosensitive layer may contain only the compound (10-1) as the hole transport material.

The hole transport material is preferably contained in the photosensitive layer in an amount of at least 10 parts by mass and no greater than 200 parts by mass relative to 100 parts by mass of the binder resin, and more preferably at least 10 parts by mass and no greater than 100 parts by mass.

(Binder Resin)

Examples of binder resins include thermoplastic resins, thermosetting resins, and photocurable resins. Examples of thermoplastic resins include polycarbonate resins, polyarylate resins, styrene-butadiene copolymers, styrene-acrylonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins include silicone resins, epoxy resins, phenolic resins, urea resins, and melamine resins. Examples of photocurable resins include acrylic acid adducts of epoxy compounds and acrylic acid adducts of urethane compounds. The photosensitive layer may contain only one of the binder resins listed above or two or more of the binder resins listed above.

Among the above-listed resins, a polycarbonate resin is preferable since use of a polycarbonate resin enables production of a photosensitive layer excellent in balance between processability, mechanical characteristics, optical properties, and abrasion resistance. Examples of polycarbonate resins include bisphenol ZC polycarbonate resin, bisphenol C polycarbonate resin, bisphenol A polycarbonate resin, and bisphenol Z polycarbonate resin. The bisphenol Z polycarbonate resin is a polycarbonate resin including a repeating unit represented by chemical formula (20) shown below. In the following description, the polycarbonate resin including the repeating unit represented by chemical formula (20) may be referred to as a polycarbonate resin (20). The photosensitive layer may contain only the polycarbonate resin (20) as the binder resin.

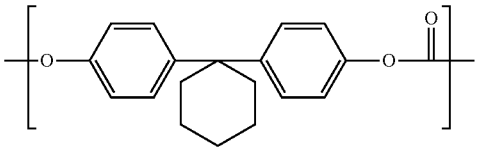

(20)

(Additive)

Examples of additives include antidegradants (e.g., antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of antioxidants include hindered phenols (e.g., di(tert-butyl)p-cresol), hindered amine, paraphenylenediamine, arylalkane, hydroquinone, spirochromane, spiroindanone, derivatives of the aforementioned compounds, organosulfur compounds, and organophosphorus compounds.

<Conductive Substrate>

No specific limitation is placed on the conductive substrate other than being usable as a conductive substrate of a photosensitive member. It is only required that at least a surface portion thereof be formed from a conductive material. An example of the conductive substrate is a conductive substrate formed from a conductive material. Another example of the conductive substrate is a conductive substrate coated with a conductive material. Examples of conductive materials include aluminum, iron, copper, tin, platinum, silver, vanadium, molybdenum, chromium, cadmium, titanium, nickel, palladium, indium, stainless steel, and brass. One of the conductive materials listed above may be used independently, or two or more of the conductive materials listed above may be used in combination (for example, as an alloy). Among the conductive materials listed above, aluminum or an aluminum alloy is preferable in terms of excellent mobility of charge from the photosensitive layer to the conductive substrate.

Shape of the conductive substrate is appropriately selected according to a configuration of an image forming apparatus. Examples of the shape of the conductive substrate include a sheet-like shape and a drum-like shape. Thickness of the conductive substrate is appropriately selected according to the shape of the conductive substrate.

<Intermediate Layer>

The intermediate layer (undercoat layer) contains for example inorganic particles and a resin for intermediate layer use (an intermediate layer resin). It is thought that the presence of the intermediate layer facilitates flow of current generated when the photosensitive member is exposed to light, and inhibits increase in resistance while also maintaining insulation to a sufficient degree so as to inhibit leakage current from occurring.

Examples of inorganic particles include particles of metals (e.g., aluminum, iron, and copper), particles of metal oxides (e.g., titanium oxide, alumina, zirconium oxide, tin oxide, and zinc oxide), and particles of non-metal oxide (e.g., silica). Only one type of inorganic particles listed above may be used independently, or two or more types of inorganic particles listed above may be used in combination.

No specific limitation is placed on the intermediate layer resin other than being usable as a resin for intermediate layer formation. The intermediate layer may contain an additive. Examples of additives that may be contained in the intermediate layer are the same as the examples of additives that may be contained in the photosensitive layer.

<Photosensitive Member Production Method>

The photosensitive member is produced as described below, for example. The photosensitive member is produced by drying an application liquid for photosensitive layer formation applied on a conductive substrate. The application liquid for photosensitive layer formation is prepared by dissolving or dispersing in a solvent a charge generating material, an electron transport material, and any components to be added as necessary (e.g., a hole transport material, a binder resin, and an additive).

No specific limitation is placed on the solvent contained in the application liquid for photosensitive layer formation so long as the respective components contained in the application liquid can be dissolved or dispersed therein. Examples of the solvent include alcohols (e.g., methanol, ethanol, isopropanol, and butanol), aliphatic hydrocarbons (e.g., n-hexane, octane, and cyclohexane), aromatic hydrocarbons (e.g., benzene, toluene, and xylene), halogenated hydrocarbons (e.g., dichloromethane, dichloroethane, carbon tetrachloride, and chlorobenzene), ethers (e.g., dimethyl ether, diethyl ether, tetrahydrofuran, ethylene glycol dimethyl ether, diethylene glycol dimethyl ether, and propylene glycol monomethyl ether), ketones (e.g., acetone, methyl ethyl ketone, and cyclohexanone), esters (e.g., ethyl acetate and methyl acetate), dimethyl formaldehyde, dimethyl formamide, and dimethyl sulfoxide. One of the solvents listed above may be used independently, or two or more of the solvents listed above may be used in combination. In order to improve workability in production of the photosensitive member, a non-halogen solvent (solvent other than a halogenated hydrocarbon) is preferably used as the solvent.

The application liquid for photosensitive layer formation is prepared by mixing the respective components and dispersing the components in the solvent. Mixing or dispersion may be carried out using for example a bead mill, a roll mill, a ball mill, an attritor, a paint shaker, or an ultrasonic disperser.

The application liquid for photosensitive layer formation may contain for example a surfactant in order to improve dispersibility of the respective components.

An application method of the application liquid for photosensitive layer formation is not particularly limited so long as uniform application of the application liquid onto a conductive substrate can be achieved. Examples of application methods include blade coating, dip coating, spray coating, spin coating, and bar coating.

A drying method of the application liquid for photosensitive layer formation is not particularly limited so long as it can evaporate the solvent therein. Examples of drying methods include thermal treatment (hot-air drying) using a high-temperature dryer or a reduced-pressure dryer. Thermal treatment is carried out for example at a temperature of at least 40° C. and no greater than 150° C. for a time period of at least 3 minutes and no greater than 120 minutes.

Note that the photosensitive member production method may further include either or both of an intermediate layer formation process and a protective layer formation process, as necessary. Any known methods are appropriately selected for the intermediate layer formation process and the protective layer formation process.

Examples

The following more specifically describes the present disclosure using examples. However, the present disclosure is by no means limited to the scope of the examples.

<Materials for Photosensitive Layer Formation>

The following charge generating materials, hole transport material, binder resin, and electron transport materials were prepared as materials for forming photosensitive layers of photosensitive members.

(Charge Generating Material)

A Y-form titanyl phthalocyanine and an X-form metal-free phthalocyanine were each prepared as the charge generating material. The Y-form titanyl phthalocyanine was a titanyl phthalocyanine having a Y-form crystal structure and represented by chemical formula (CGM1) described in the embodiment. The X-form metal-free phthalocyanine was a metal-free phthalocyanine having an X-form crystal structure and represented by chemical formula (CGM2) described in the embodiment.

(Hole Transport Material)

The compound (10-1) described in the embodiment was prepared as the hole transport material.

(Binder Resin)

The polycarbonate resin (20) described in the embodiment was prepared as the binder resin. The polycarbonate resin (20) had a viscosity average molecular weight of 50,000.

(Electron Transport Material)

The compounds (1-1) to (1-5) described in the embodiment were each prepared as the electron transport material. The compounds (1-1) to (1-5) were synthesized by the following methods. Note that a percentage yield of each compound was calculated in terms of molar ratio.

Synthesis of Compound (1-1)

The compound (1-1) was synthesized according to a reaction represented by reaction formula (r-1) (also referred to below as a reaction (r-1)).

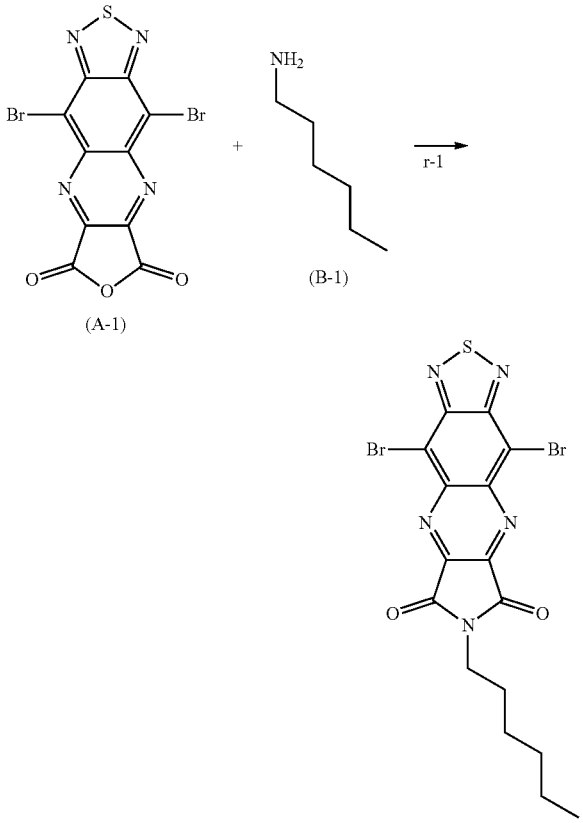

In the reaction (r-1), a compound represented by chemical formula (A-1) (also referred to below as a compound (A-1)) and a compound represented by chemical formula (B-1) (also referred to below as a compound (B-1)) were caused to react with each other to obtain the compound (1-1). Specifically, the compound (A-1) (0.416 g, 1.0 mmol) and the compound (B-1) (0.121 g, 1.2 mmol) were dissolved in picoline (30 mL) to obtain a picoline solution. The picoline solution was stirred at 150° C. for 5 hours in a nitrogen gas atmosphere. After the 5-hour stirring, water (100 mL) was added to the picoline solution for solid precipitation. The precipitated solid was collected through filtration. The collected solid was purified by silica gel column chromatography using chloroform as a developing solvent. Through the above, the compound (1-1) was obtained. The compound (1-1) had a mass yield of 0.300 g. The percentage yield of the compound (1-1) from the compound (A-1) was 60%.

Synthesis of Compounds (1-2) to (1-5)

The compounds (1-2) to (1-5) were synthesized according to the same method as for the compound (1-1) in all aspects other than the following changes. While the compound (A-1) (0.416 g, 1.0 mmol) was added in synthesis of the compound (1-1), respective compounds in amounts and of types shown in the columns under Compound (A) in Table 1 were added in synthesis of the compounds (1-2) to (1-5). While the compound (B-1) (0.121 g, 1.2 mmol) was added in synthesis of the compound (1-1), respective compounds in amounts and of types shown in the columns under Compound (B) in Table 1 were added in synthesis of the compounds (1-2) to (1-5). As a result, reaction products (respective compounds (1-2) to (1-5)) shown in Table 1 were obtained instead of the compound (1-1). Table 1 shows respective mass yields of the compounds (1-2) to (1-5). Table 1 also shows respective percentage yields of the compounds (1-2) to (1-5) from the compounds shown in the column under Compound (A).

TABLE 1

| Reaction (r-1) | | | | | | |
|---|---|---|---|---|---|---|
| | | | | Reaction product | | |
| Compound (A) | | Compound (B) | | | Mass yield | Percentage yield |
| Type | Amount | Type | Amount | Type | [g] | [%] |
| A-1 | 0.416 g (1.0 mmol) | B-1 | 0.121 g (1.2 mmol) | 1-1 | 0.300 | 60 |
| A-1 | 0.416 g (1.0 mmol) | B-2 | 0.155 g (1.2 mmol) | 1-2 | 0.290 | 55 |
| A-2 | 0.294 g (1.0 mmol) | B-1 | 0.121 g (1.2 mmol) | 1-3 | 0.189 | 50 |
| A-1 | 0.416 g (1.0 mmol) | B-3 | 0.128 g (1.2 mmol) | 1-4 | 0.278 | 55 |
| A-1 | 0.416 g (1.0 mmol) | B-4 | 0.162 g (1.2 mmol) | 1-5 | 0.320 | 60 |

Compounds represented by (A-2), (B-2), (B-3), and (B-4) in Table 1 are represented by chemical formulas shown below.

(A-2)

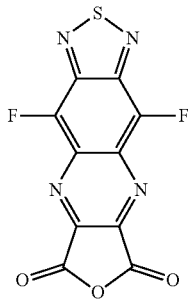

(B-2)

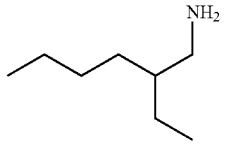

(B-3)

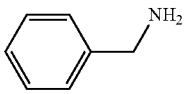

(B-4)

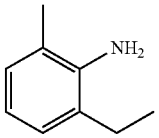

Next, $^1$H-NMR spectra of the compounds (1-1) to (1-5) were plotted using a proton nuclear magnetic resonance ($^1$H-NMR) spectrometer. The magnetic field intensity was set at 300 MHz. Deuterated chloroform ($CDCl_3$) was used as a solvent. Tetramethylsilane (TMS) was used as an internal standard substance. Chemical shift values of the $^1$H-NMR spectra of the respective compounds (1-1) and (1-2) are shown below as representative examples of the compounds (1-1) to (1-5). It was confirmed from chemical shift values of the plotted $^1$H-NMR spectra that the compounds (1-1) and (1-2) were obtained. It was also confirmed from chemical shift values of the plotted $^1$H-NMR spectra that the compounds (1-3) to (1-5) were obtained.

Compound (1-1): $^1$H-NMR (300 MHz, $CDCl_3$) δ=4.00 (t, 2H), 1.83-1.77 (m, 2H), 1.38-1.30 (m, 6H), 0.89 (t, 3H).

Compound (1-2): $^1$H-NMR (300 MHz, $CDCl_3$) δ=3.90 (d, 2H), 2.04-1.95 (m, 1H), 1.41-1.33 (m, 8H), 0.99-0.90 (m, 6H).

A compound represented by chemical formula (E-1) shown below (also referred to below as a compound (E-1)) was also prepared as an electron transport material to be used for comparative examples.

(E-1)

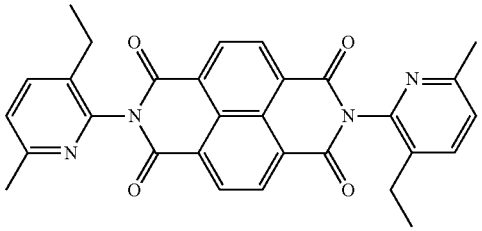

<Production of Photosensitive Member>

Photosensitive members (A-1) to (A-10), (B-1), and (B-2) were produced using the materials for photosensitive layer formation.

(Production of Photosensitive Member (A-1))

A vessel was charged with 2 parts by mass of the X-form metal-free phthalocyanine as the charge generating material, 50 parts by mass of the compound (10-1) as the hole transport material, 30 parts by mass of the compound (1-1) as the electron transport material, 100 parts by mass of the polycarbonate resin (20) as the binder resin, and 600 parts by mass of tetrahydrofuran as a solvent. The vessel contents were mixed for 12 hours using a ball mill for dispersion of the materials in the solvent. Through the above, an application liquid for photosensitive layer formation was obtained. The application liquid for photosensitive layer formation was applied onto a conductive substrate (drum-shaped aluminum support, diameter: 30 mm, total length: 238.5 mm) by blade coating. The applied application liquid for photosensitive layer formation was dried by blowing hot air at 120° C. for 80 minutes. Through the above, a single-layer photosensitive layer (film thickness: 30 μm) was formed on the conductive substrate. As a result, the photosensitive member (A-1) was obtained.

(Production of Photosensitive Members (A-2) to (A-10), (B-1), and (B-2))

The photosensitive members (A-2) to (A-10), (B-1), and (B-2) were produced by the same method as that for the photosensitive member (A-1) in all aspects other than the following changes. While the X-form metal-free phthalocyanine was used as the charge generating material in production of the photosensitive member (A-1), charge generating materials shown in Table 2 were used in production of the respective photosensitive members (A-2) to (A-10), (B-1), and (B-2). While the compound (1-1) was used as the electron transport material in production of the photosensitive member (A-1), electron transport materials shown in Table 2 were used in production of the respective photosensitive members (A-2) to (A-10), (B-1), and (B-2).

<Evaluation of Sensitivity Characteristics>

Evaluation of sensitivity characteristics was performed on each of the photosensitive members (A-1) to (A-10), (B-1), and (B-2). Sensitivity characteristics were evaluated in an environment at a temperature of 23° C. and a relative humidity of 50%. First, a surface of the photosensitive member was charged to +600 V using a drum sensitivity test device (product of Gen-Tech, Inc.). Next, monochromatic light (wavelength: 780 nm, half-width: 20 nm, optical energy: 1.5 μJ/cm$^2$) was taken out from white light of a halogen lamp using a bandpass filter. The surface of the photosensitive member was irradiated with the taken-out monochromatic light. A surface potential of the photosensitive member was measured when 50 milliseconds elapsed from termination of the irradiation. The surface potential measured as above was determined to be a post-exposure potential ($V_L$, unit +V). Measured post-irradiation potentials ($V_L$) of the respective photosensitive members are shown in Table 2. Note that a smaller positive value of the post-exposure potential ($V_L$) indicates more excellent sensitivity characteristics (especially, sensitivity characteristics to exposure light) of the photosensitive member.

<Evaluation of Presence or Absence of Crystallized Part>

The entire surface (photosensitive layer) of each of the photosensitive members (A-1) to (A-10), (B-1), and (B-2) was observed with unaided eyes. The presence or absence of a crystallized part of the photosensitive layer was confirmed. Results of the confirmation are shown in Table 2.

In Table 2, the characters CGM, ETM, $V_L$, X—$H_2$Pc, and Y-TiOPc indicate charge generating material, electron transport material, post-exposure potential, X-form metal-free phthalocyanine, and Y-form titanyl phthalocyanine, respectively. In Table 2, the term "No" indicates that no crystallized part was observed in a corresponding photosensitive layer and the term "Somewhat crystallized" indicates that a somewhat crystallized part was observed in the photosensitive layer.

TABLE 2

| | Photosensitive member | CGM | ETM | $V_L$ (+V) | Presence or absence of crystallized part |
|---|---|---|---|---|---|
| Example 1 | A-1 | X—$H_2$Pc | 1-1 | 104 | No |
| Example 2 | A-2 | Y—TiOPc | 1-1 | 100 | No |
| Example 3 | A-3 | X—$H_2$Pc | 1-2 | 103 | No |
| Example 4 | A-4 | Y—TiOPc | 1-2 | 100 | No |
| Example 5 | A-5 | X—$H_2$Pc | 1-3 | 106 | No |
| Example 6 | A-6 | Y—TiOPc | 1-3 | 102 | No |
| Example 7 | A-7 | X—$H_2$Pc | 1-4 | 110 | No |
| Example 8 | A-8 | Y—TiOPc | 1-4 | 106 | No |
| Example 9 | A-9 | X—$H_2$Pc | 1-5 | 108 | No |
| Example 10 | A-10 | Y—TiOPc | 1-5 | 104 | No |
| Comparative Example 1 | B-1 | X—$H_2$Pc | E-1 | 135 | Somewhat crystallized |
| Comparative Example 2 | B-2 | Y—TiOPc | E-1 | 130 | Somewhat crystallized |

The photosensitive members (A-1) to (A-10) each included a conductive substrate and a single-layer photosensitive layer. The photosensitive layer contained at least a charge generating material and the compound (1). Specifically, the photosensitive layer contained any one of the compounds (1-1) to (1-5) encompassed by compounds represented by general formula (1). As evident from Table 2, the post-exposure potential of each of the photosensitive members (A-1) to (A-10) was accordingly a small positive value, which indicated excellent sensitivity characteristics of the photosensitive member. Furthermore, no crystallized part was observed in the photosensitive layer of each of the photosensitive members (A-1) to (A-10), which indicated that crystallization of the photosensitive layer was inhibited.

By contrast, the photosensitive layer of each of the photosensitive members (B-1) and (B-2) did not contain the compound (1). Specifically, although the photosensitive layer of each of the photosensitive members (B-1) and (B-2) contained the compound (E-1), the compound (E-1) was not a compound encompassed by compounds represented by the general formula (1). As evident from Table 2, the post-exposure potential of each of the photosensitive members (B-1) and (B-2) was a large positive value, which indicted poor sensitivity characteristics of the photosensitive member. Furthermore, a somewhat crystallized part was observed in the photosensitive layer of each of the photosensitive members (B-1) and (B-2), which indicated that crystallization of the photosensitive layer was not inhibited.

From the above, it was indicated that the photosensitive member according to the present disclosure was excellent in sensitivity characteristics.

What is claimed is:

1. An electrophotographic photosensitive member comprising a conductive substrate and a photosensitive layer, wherein the photosensitive layer is a single layer, the photosensitive layer contains at least a charge generating material and a compound represented by a general formula (1) shown below:

(1)

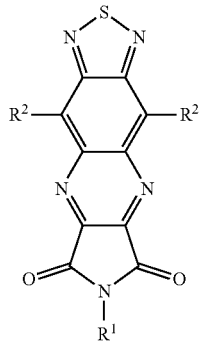

where in the general formula (1), $R^1$ represents an aryl group having a carbon number of at least 6 and no greater than 22 and optionally having an alkyl group having a carbon number of at least 1 and no greater than 10, an alkyl group having a carbon number of at least 3 and no greater than 20, an aralkyl group having a carbon number of at least 7 and no greater than 20, a cycloalkyl group having a carbon number of at least 3 and no greater than 20, or an alkoxy group having a carbon number of at least 1 and no greater than 6, and chemical groups $R^2$ each represent a halogen atom.

2. The electrophotographic photosensitive member according to claim 1, wherein in the general formula (1), $R^1$ represents an aryl group having a carbon number of at least 6 and no greater than 22 and optionally having an alkyl group having a carbon number of at least 1 and no greater than 10, an alkyl group having a carbon number of at least 3 and no greater than 20, or an aralkyl group having a carbon number of at least 7 and no greater than 20.

3. The electrophotographic photosensitive member according to claim 1, wherein in the general formula (1), $R^1$ represents an alkyl group having a carbon number of at least 4 and no greater than 10.

4. The electrophotographic photosensitive member according to claim 1, wherein in the general formula (1), $R^1$ represents an alkyl group having a carbon number of at least 4 and no greater than 10, and the chemical groups $R^2$ each represent a bromine atom.

5. The electrophotographic photosensitive member according to claim 1, wherein the compound represented by the general formula (1) is a compound represented by a chemical formula (1-1), (1-2), (1-3), (1-4), or (1-5) shown below:

(1-1)

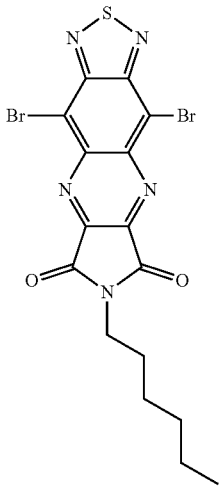

(1-2)

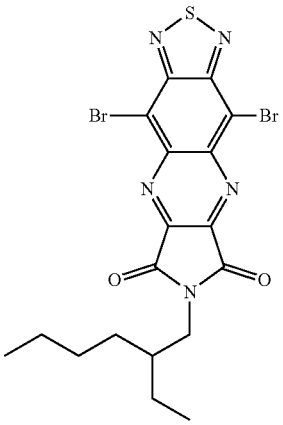

(1-3)

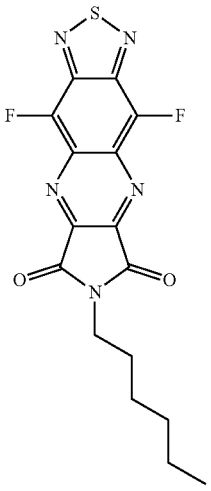

-continued (1-4)

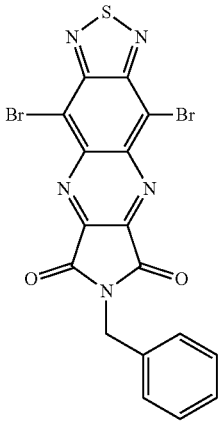

(1-5)

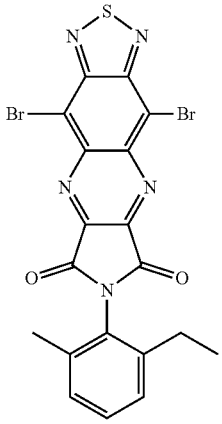

6. The electrophotographic photosensitive member according to claim 1, wherein the photosensitive layer further contains a compound represented by a general formula (10) shown below:

(10)

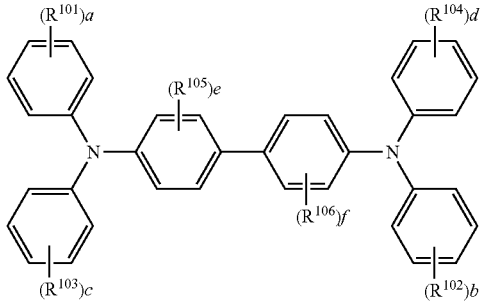

where in the general formula (10), $R^{101}$, $R^{102}$, $R^{103}$, $R^{104}$, $R^{105}$, and $R^{106}$ each represent, independently of one another, an alkyl group having a carbon number of at least 1 and no greater than 6, an alkoxy group having a carbon number of at least 1 and no greater than 6, or an aryl group having a carbon number of at least 6 and no greater than 14, a, b, c, and d each represent, independently of one another, an integer of at least 0 and no greater than 5, and e and f each represent, independently of each other, an integer of at least 0 and no greater than 4.

7. The electrophotographic photosensitive member according to claim 6, wherein the compound represented by the general formula (10) is a compound represented by a chemical formula (10-1) shown below:

(10-1)

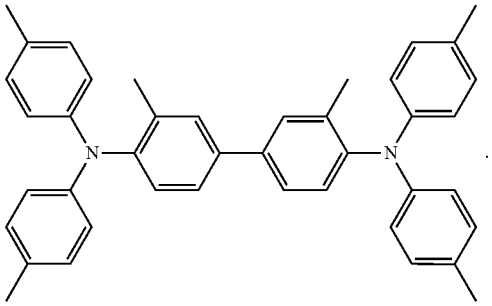

8. The electrophotographic photosensitive member according to claim 1, wherein the photosensitive layer further contains a polycarbonate resin including a repeating unit represented by a chemical formula (20):

(20)

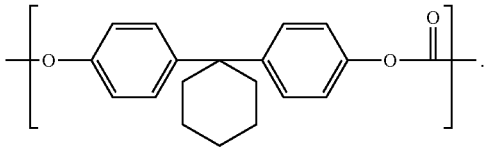

* * * * *